US007950939B2

(12) United States Patent
Hughes et al.

(10) Patent No.: US 7,950,939 B2
(45) Date of Patent: May 31, 2011

(54) MEDIUM VOLTAGE SEPARABLE INSULATED ENERGIZED BREAK CONNECTOR

(75) Inventors: David Charles Hughes, Rubicon, WI (US); Brian Todd Steinbrecher, Brookfield, WI (US); John Mitchell Makal, Memnomonee Falls, WI (US); Frank John Muench, Waukesha, WI (US)

(73) Assignee: Cooper Technologies Company, Houston, TX (US)

( * ) Notice: Subject to any disclaimer, the term of this patent is extended or adjusted under 35 U.S.C. 154(b) by 344 days.

(21) Appl. No.: 11/677,703

(22) Filed: Feb. 22, 2007

(65) Prior Publication Data

US 2008/0207022 A1 Aug. 28, 2008

(51) Int. Cl.
*H01R 13/53* (2006.01)

(52) U.S. Cl. ..... 439/181; 439/921

(58) Field of Classification Search ..... 439/181, 439/183–185, 187, 921
See application file for complete search history.

(56) References Cited

U.S. PATENT DOCUMENTS

| | | | |
|---|---|---|---|
| 1,903,956 | A | 4/1933 | Christie et al. |
| 2,953,724 | A | 9/1960 | Hilfiker et al. |
| 3,115,329 | A | 12/1963 | Wing et al. |
| 3,315,132 | A | 4/1967 | Raymond |
| 3,392,363 | A | 7/1968 | Geis, Jr. et al. |
| 3,471,669 | A | 10/1969 | Curtis |
| 3,474,386 | A | 10/1969 | Link |
| 3,509,516 | A | 4/1970 | Phillips |
| 3,509,518 | A | 4/1970 | Phillips |
| 3,513,425 | A | 5/1970 | Arndt |
| 3,539,972 | A | 11/1970 | Silva et al. |
| 3,542,986 | A | 11/1970 | Kotski |
| 3,546,535 | A | 12/1970 | Van Riemsdijk |
| 3,576,493 | A | 4/1971 | Tachick et al. |
| 3,594,685 | A | 7/1971 | Cunningham |
| 3,652,975 | A | 3/1972 | Keto |
| 3,654,590 | A | 4/1972 | Brown |
| 3,663,928 | A | 5/1972 | Keto |
| 3,670,287 | A | 6/1972 | Keto |
| 3,678,432 | A | 7/1972 | Boliver |
| 3,720,904 | A | 3/1973 | De Sio |
| 3,725,846 | A | 4/1973 | Strain |
| 3,740,503 | A | 6/1973 | Tomohiro et al. |
| 3,740,511 | A | 6/1973 | Westmoreland |
| 3,798,586 | A | 3/1974 | Huska |
| 3,826,860 | A | 7/1974 | De Sio et al. |
| 3,845,233 | A | 10/1974 | Burton |
| 3,860,322 | A | 1/1975 | Sankey et al. |
| 3,915,534 | A | 10/1975 | Yonkers |
| 3,924,914 | A | 12/1975 | Banner |

(Continued)

FOREIGN PATENT DOCUMENTS

| | | |
|---|---|---|
| DE | 3110609 | 10/1982 |

(Continued)

OTHER PUBLICATIONS

U.S. Appl. No. 11/809,508, Hughes et al.

(Continued)

*Primary Examiner* — Xuong M Chung-Trans
(74) *Attorney, Agent, or Firm* — King & Spalding LLP

(57) ABSTRACT

Medium voltage separable insulated connector system for power distribution systems and configured to make and break energized connections at rated voltage but in the absence of load current.

26 Claims, 7 Drawing Sheets

U.S. PATENT DOCUMENTS

| | | | | |
|---|---|---|---|---|
| 3,945,699 | A | 3/1976 | Westrom | |
| 3,949,343 | A | 4/1976 | Yonkers | |
| 3,953,099 | A | 4/1976 | Wilson | |
| 3,955,874 | A | 5/1976 | Boliver | |
| 3,957,332 | A | 5/1976 | Lambert, III | |
| 3,960,433 | A | 6/1976 | Boliver | |
| 4,029,380 | A | 6/1977 | Yonkers | |
| 4,040,696 | A | 8/1977 | Wada et al. | |
| 4,067,636 | A | 1/1978 | Boliver et al. | |
| 4,088,383 | A | 5/1978 | Fischer et al. | |
| 4,102,608 | A | 7/1978 | Balkau et al. | |
| 4,103,123 | A | 7/1978 | Marquardt | |
| 4,107,486 | A | 8/1978 | Evnas | |
| 4,113,339 | A | 9/1978 | Eley | |
| 4,123,131 | A | 10/1978 | Pearce, Jr. et al. | |
| 4,152,643 | A | 5/1979 | Schweitzer | |
| 4,154,993 | A | 5/1979 | Kumbera et al. | |
| 4,161,012 | A | 7/1979 | Cunningham | |
| 4,163,118 | A | 7/1979 | Marien et al. | |
| 4,186,985 | A | 2/1980 | Stepniak et al. | |
| 4,202,591 | A * | 5/1980 | Borgstrom | 439/185 |
| 4,203,017 | A | 5/1980 | Lee | |
| 4,210,381 | A | 7/1980 | Borgstrom | |
| 4,223,179 | A | 9/1980 | Lusk et al. | |
| 4,260,214 | A | 4/1981 | Dorn | |
| 4,343,356 | A | 8/1982 | Riggs et al. | |
| 4,353,611 | A | 10/1982 | Siebens et al. | |
| 4,354,721 | A | 10/1982 | Luzzi | |
| 4,360,967 | A | 11/1982 | Luzzi et al. | |
| 4,443,054 | A | 4/1984 | Ezawa et al. | |
| 4,463,227 | A | 7/1984 | Dizon et al. | |
| 4,484,169 | A | 11/1984 | Nishikawa | |
| 4,500,935 | A | 2/1985 | Tsuruta et al. | |
| 4,508,413 | A | 4/1985 | Bailey | |
| 4,568,804 | A | 2/1986 | Luehring | |
| 4,600,260 | A | 7/1986 | Stepniak et al. | |
| 4,626,755 | A | 12/1986 | Butcher et al. | |
| 4,638,403 | A | 1/1987 | Amano et al. | |
| 4,678,253 | A | 7/1987 | Hicks et al. | |
| 4,688,013 | A | 8/1987 | Nishikawa et al. | |
| 4,700,258 | A | 10/1987 | Farmer | |
| 4,715,104 | A | 12/1987 | Schoenwetter et al. | |
| 4,722,694 | A | 2/1988 | Makal et al. | |
| 4,767,894 | A | 8/1988 | Schombourg | |
| 4,767,941 | A | 8/1988 | Brand et al. | |
| 4,779,341 | A | 10/1988 | Roscizewski | |
| 4,793,637 | A | 12/1988 | Laipply et al. | |
| 4,799,895 | A * | 1/1989 | Borgstrom | 439/183 |
| 4,820,183 | A | 4/1989 | Knapp et al. | |
| 4,822,291 | A * | 4/1989 | Cunningham | 439/187 |
| 4,822,951 | A | 4/1989 | Wilson et al. | |
| 4,834,677 | A | 5/1989 | Archang | |
| 4,857,021 | A | 8/1989 | Boliver et al. | |
| 4,863,392 | A | 9/1989 | Borgstrom et al. | |
| 4,867,687 | A | 9/1989 | Williams et al. | |
| 4,871,888 | A | 10/1989 | Bestel | |
| 4,891,016 | A | 1/1990 | Luzzi et al. | |
| 4,911,655 | A | 3/1990 | Pinyan et al. | |
| 4,946,393 | A | 8/1990 | Borgstrom | |
| 4,955,823 | A | 9/1990 | Luzzi | |
| 4,972,049 | A | 11/1990 | Muench | |
| 4,982,059 | A | 1/1991 | Bestel | |
| 5,025,121 | A | 6/1991 | Allen et al. | |
| 5,045,656 | A | 9/1991 | Kojima | |
| 5,045,968 | A | 9/1991 | Suzuyama et al. | |
| 5,053,584 | A | 10/1991 | Chojnowski | |
| 5,101,080 | A | 3/1992 | Ferenc | |
| 5,114,357 | A | 5/1992 | Luzzi | |
| 5,128,824 | A | 7/1992 | Yaworski et al. | |
| 5,130,495 | A | 7/1992 | Thompson | |
| 5,166,861 | A | 11/1992 | Krom | |
| 5,175,403 | A | 12/1992 | Hamm et al. | |
| 5,213,517 | A | 5/1993 | Kerek et al. | |
| 5,221,220 | A | 6/1993 | Roscizewski | |
| 5,230,142 | A | 7/1993 | Roscizewski | |
| 5,230,640 | A | 7/1993 | Tardif | |
| 5,248,263 | A | 9/1993 | Sakurai et al. | |
| 5,266,041 | A | 11/1993 | De Luca | |
| 5,277,605 | A | 1/1994 | Roscizewski et al. | |
| 5,356,304 | A | 10/1994 | Colleran | |
| 5,358,420 | A | 10/1994 | Cairns et al. | |
| 5,359,163 | A | 10/1994 | Woodard | |
| 5,393,240 | A | 2/1995 | Makal et al. | |
| 5,422,440 | A | 6/1995 | Palma | |
| 5,427,538 | A | 6/1995 | Knapp et al. | |
| 5,429,519 | A | 7/1995 | Murakami et al. | |
| 5,433,622 | A | 7/1995 | Galambos | |
| 5,435,747 | A | 7/1995 | Franckx et al. | |
| 5,445,533 | A | 8/1995 | Roscizewski et al. | |
| 5,468,164 | A | 11/1995 | Demissy | |
| 5,492,487 | A | 2/1996 | Cairns et al. | |
| 5,525,069 | A | 6/1996 | Roscizewski et al. | |
| 5,589,671 | A | 12/1996 | Hackbarth et al. | |
| 5,619,021 | A | 4/1997 | Yamamoto et al. | |
| 5,641,310 | A | 6/1997 | Tiberio, Jr. | |
| 5,655,921 | A | 8/1997 | Makal | |
| 5,661,280 | A | 8/1997 | Kuss et al. | |
| 5,667,060 | A | 9/1997 | Luzzi | |
| 5,717,185 | A | 2/1998 | Smith | |
| 5,736,705 | A | 4/1998 | Bestel et al. | |
| 5,737,874 | A | 4/1998 | Sipos et al. | |
| 5,747,765 | A | 5/1998 | Bestel et al. | |
| 5,747,766 | A | 5/1998 | Waino et al. | |
| 5,757,260 | A | 5/1998 | Smith et al. | |
| 5,766,030 | A | 6/1998 | Suzuki | |
| 5,766,517 | A | 6/1998 | Goedde et al. | |
| 5,795,180 | A | 8/1998 | Siebens | |
| 5,808,258 | A | 9/1998 | Luzzi | |
| 5,816,835 | A | 10/1998 | Meszaros | |
| 5,846,093 | A | 12/1998 | Muench et al. | |
| 5,857,862 | A | 1/1999 | Muench et al. | |
| 5,864,942 | A | 2/1999 | Luzzi | |
| 5,912,604 | A | 6/1999 | Harvey et al. | |
| 5,917,167 | A | 6/1999 | Bestel | |
| 5,936,825 | A | 8/1999 | DuPont | |
| 5,949,641 | A | 9/1999 | Walker et al. | |
| 5,953,193 | A | 9/1999 | Ryan | |
| 5,957,712 | A | 9/1999 | Stepniak | |
| 6,022,247 | A | 2/2000 | Akiyama et al. | |
| 6,040,538 | A | 3/2000 | French et al. | |
| 6,042,407 | A | 3/2000 | Scull et al. | |
| 6,069,321 | A | 5/2000 | Wagener et al. | |
| 6,130,394 | A | 10/2000 | Hogl | |
| 6,168,447 | B1 | 1/2001 | Stepniak et al. | |
| 6,205,029 | B1 | 3/2001 | Byre et al. | |
| 6,213,799 | B1 | 4/2001 | Jazowski et al. | |
| 6,220,888 | B1 | 4/2001 | Correa | |
| 6,227,908 | B1 | 5/2001 | Aumeier | |
| 6,250,950 | B1 | 6/2001 | Pallai | |
| 6,280,659 | B1 | 8/2001 | Sundin | |
| 6,332,785 | B1 | 12/2001 | Muench, Jr. et al. | |
| 6,338,637 | B1 | 1/2002 | Muench, Jr. et al. | |
| 6,362,445 | B1 | 3/2002 | Marchand et al. | |
| 6,364,216 | B1 | 4/2002 | Martin | |
| 6,416,338 | B1 | 7/2002 | Berlovan | |
| 6,453,776 | B1 | 9/2002 | Beattie et al. | |
| 6,504,103 | B1 | 1/2003 | Meyer et al. | |
| 6,517,366 | B2 | 2/2003 | Bertini et al. | |
| 6,520,795 | B1 | 2/2003 | Jazowski | |
| 6,538,312 | B1 | 3/2003 | Peterson et al. | |
| 6,542,056 | B2 | 4/2003 | Nerstron et al. | |
| 6,566,996 | B1 | 5/2003 | Douglass et al. | |
| 6,585,531 | B1 | 7/2003 | Stepniak et al. | |
| 6,664,478 | B2 | 12/2003 | Mohan et al. | |
| 6,674,159 | B1 | 1/2004 | Peterson et al. | |
| 6,689,947 | B2 | 2/2004 | Ludwig | |
| 6,705,898 | B2 | 3/2004 | Pechstein et al. | |
| 6,709,294 | B1 | 3/2004 | Cohen et al. | |
| 6,733,322 | B2 | 5/2004 | Boemmel et al. | |
| 6,744,255 | B1 | 6/2004 | Steinbrecher et al. | |
| 6,790,063 | B2 | 9/2004 | Jazowski et al. | |
| 6,796,820 | B2 | 9/2004 | Jazowski et al. | |
| 6,809,413 | B1 | 10/2004 | Peterson et al. | |
| 6,811,418 | B2 | 11/2004 | Jazowski et al. | |
| 6,830,475 | B2 | 12/2004 | Jazowski et al. | |
| 6,843,685 | B1 | 1/2005 | Borgstrom et al. | |
| 6,888,086 | B2 | 5/2005 | Daharsh et al. | |

| | | | | |
|---|---|---|---|---|
| 6,905,356 | B2 | 6/2005 | Jazowski et al. | |
| 6,936,947 | B1 | 8/2005 | Leijon et al. | |
| 6,939,151 | B2 | 9/2005 | Borgstrom et al. | |
| 6,972,378 | B2 * | 12/2005 | Schomer et al. | 174/142 |
| 6,984,791 | B1 | 1/2006 | Meyer et al. | |
| 7,018,236 | B2 | 3/2006 | Nishio et al. | |
| 7,019,606 | B2 | 3/2006 | Williams et al. | |
| 7,044,760 | B2 | 5/2006 | Borgstrom et al. | |
| 7,044,769 | B2 | 5/2006 | Zhao et al. | |
| 7,050,278 | B2 | 5/2006 | Poulsen | |
| 7,059,879 | B2 * | 6/2006 | Krause et al. | 439/181 |
| 7,077,672 | B2 | 7/2006 | Krause et al. | |
| 7,079,367 | B1 | 7/2006 | Liljestrand | |
| 7,083,450 | B1 | 8/2006 | Hughes | |
| 7,104,822 | B2 | 9/2006 | Jazowski et al. | |
| 7,104,823 | B2 | 9/2006 | Jazowski et al. | |
| 7,108,568 | B2 | 9/2006 | Jazowski et al. | |
| 7,134,889 | B2 | 11/2006 | Hughes et al. | |
| 7,150,098 | B2 | 12/2006 | Borgstrom et al. | |
| 7,168,983 | B2 | 1/2007 | Graf et al. | |
| 7,170,004 | B2 | 1/2007 | Gramespacher et al. | |
| 7,182,647 | B2 | 2/2007 | Muench et al. | |
| 7,212,389 | B2 | 5/2007 | Hughes | |
| 7,216,426 | B2 | 5/2007 | Borgstrom et al. | |
| 7,234,980 | B2 | 6/2007 | Jazowski et al. | |
| 7,247,061 | B2 | 7/2007 | Hoxha et al. | |
| 7,247,266 | B2 | 7/2007 | Bolcar | |
| 7,258,585 | B2 | 8/2007 | Hughes et al. | |
| 7,278,889 | B2 * | 10/2007 | Muench et al. | 439/729 |
| 7,341,468 | B2 * | 3/2008 | Hughes et al. | 439/185 |
| 7,384,287 | B2 * | 6/2008 | Hughes et al. | 439/181 |
| 7,413,455 | B2 * | 8/2008 | Hughes et al. | 439/187 |
| 7,588,469 | B2 | 9/2009 | Luzzi | |
| 2001/0008810 | A1 | 7/2001 | George et al. | |
| 2002/0055290 | A1 | 5/2002 | Jazowski et al. | |
| 2003/0228779 | A1 | 12/2003 | Jazowski et al. | |
| 2004/0121657 | A1 | 6/2004 | Muench et al. | |
| 2005/0208808 | A1 | 9/2005 | Jazowski et al. | |
| 2005/0212629 | A1 | 9/2005 | William et al. | |
| 2005/0260876 | A1 | 11/2005 | Krause et al. | |
| 2006/0110983 | A1 | 5/2006 | Muench et al. | |
| 2006/0148292 | A1 | 7/2006 | Hughes et al. | |
| 2006/0160388 | A1 | 7/2006 | Hughes et al. | |
| 2006/0216992 | A1 | 9/2006 | Hughes et al. | |
| 2007/0026713 | A1 | 2/2007 | Hughes et al. | |
| 2007/0026714 | A1 | 2/2007 | Hughes et al. | |
| 2007/0032110 | A1 | 2/2007 | Hughes et al. | |
| 2007/0097601 | A1 | 5/2007 | Hughes et al. | |
| 2007/0108164 | A1 | 5/2007 | Muench et al. | |

FOREIGN PATENT DOCUMENTS

| | | | |
|---|---|---|---|
| DE | 3521365 | | 2/1987 |
| DE | 19906972 | A1 | 2/1999 |
| EP | 0624940 | | 11/1994 |
| EP | 0782162 | A2 | 7/1997 |
| EP | 0957496 | | 11/1999 |
| FR | 2508729 | | 12/1982 |
| GB | 105227 | | 2/1918 |
| GB | 2254493 | | 10/1992 |
| JP | S62-198677 | | 12/1987 |
| JP | S63-93081 | | 6/1988 |
| JP | H1-175181 | | 7/1989 |
| JP | H3-88279 | | 9/1991 |
| JP | H4-54164 | | 5/1992 |
| WO | 00/41199 | | 7/2000 |
| WO | WO 00/41199 | | 7/2000 |

OTHER PUBLICATIONS

U.S. Appl. No. 11/738,995, Steinbrecher et al.
U.S. Appl. No. 11/738,948, Hughes et al.
U.S. Appl. No. 11/738,941, Hughes et al.
U.S. Appl. No. 11/688,673, Hughes et al.
U.S. Appl. No. 11/688,648, Hughes et al.
U.S. Appl. No. 11/677,703, Hughes et al.
U.S. Appl. No. 11/676,861, Hughes et al.
Loadbreak Apparatus Connectors Service Information 500-26, Cooper Power Systems, May 2003, Waukesha, WI.
Deadbreak Apparatus Connectors Electrical Apparatus, Cooper Power Systems, Jul. 1999, Marketing Material.
Link-Op 600A Operable Connector System, Marketing Material.
Installation Instructions, 650LK-B Link Operable Connector System (Bolted) May 1, 1989.
G&W Electric Co.; "Breakthrough in Switching Technology; Solid Dielectric Switchgear"; Oct. 2001; Blue Island, IL.
Cooper Power Systems; "Padmounted Switchgear; Type RVAC, Vacuum-Break Switch, Oil-Insulated or SF.sub.6-Insulated; Electrical Apparatus 285-50"; Jul. 1998.
Cooper Power Systems; "Padmounted Switchgear; Type MOST Oil Switch; Electrical Apparatus 285-20"; Jul. 1998.
Cooper Power Systems; "Molded Rubber Products; 600 A 35 kV Class Bol-T.TM. Deadbreak Connector; Electrical Apparatus 600-50"; Jan. 1990.
Cooper Power Systems; "Padmounted Switchgear; Kyle.RTM. Type VFI Vacuum Fault Interrupter; Electrical Apparatus 285-10", Jan. 1998.
"Loadbreak Appatus Connectors, 200 A 25kV Class—Expanded Range Loadbreak Elbow Connector, Electrical Apparatus 500-28"; Cooper Power Systems; pp. 1-4; (Jan. 2004).
Kevin Fox, "The Cooper Posi-Break.TM. Solution to Separable Connector Switching Problems at Wisconsin Electric Power Company," Component Products, Bulletin No. 98065, copyright 1998 Cooper Power Systems, MI 10/98 5M, 2 total pages.
"The Cooper Posi-Break.TM., Elbow and Cap, Engineered Solution Increases Strike Distance and Improves Reliability," copyright 1998 Cooper Power Systems, Inc., Bulletin 98014, MI 398/15M, 6 total pages.
Loadbreak Apparatus Connectors, "200 A 25 kV Class Loadbreak Bushing Insert," Service Information 500-26, Cooper Power Systems, May 2003, pp. 1-2.
Loadbreak Apparatus Connectors, "200 A kV Class Cooper Posi-Break.TM. Expanded Range Loadbreak Elbow Connector," Service Information 500-29, Cooper Power Systems, Jan. 2004, pp. 1-4.
Product Brief, "Latched Elbow Indicator," Cooper Power Systems, Bulletin 94014, Apr. 1994, 1 total page.
"Stick-OPerable 600-Amp Connector Systems," *Elastimold, Amerace Corporation*, Feb. 1984, 11 pages.
"Molded Rubber Products, 600 A 15 kV Class T-OP™ II Deadbreak Connector Electrical Apparatus 600-12," *Cooper Power Systems*, Jul. 2005, pp. 1-4.
"Molded Rubber Products, 600 A 15 and 25 kV Deadbreak Accessories, Tools, Replacement Parts Electrical Apparatus 600-46"; *Cooper Power Systems*, Jul. 1997, pp. 1-4.
"Molded Rubber Products, 600 A 25 kV Class BT-TAP™ Deadbreak Connecor Electrical Apparatus, 600-35," *Cooper Power Systems*, Mar. 2003, pp. 1-5.
"Deadbreak Apparatus Connectors, 600 A 15/25 kV Class Bol-T™ Deadbreak Connector Electrical Apparatus 600-10," *Cooper Power Systems*, Aug. 2002, 6 pages.
"Deadbreak Apparatus Connector, 600 A 25 kV Class Bushing Adapter for T-OP™ II Connector Systems (including LRTP and Bushing Extender) Electrical Appparatus 600-38," *Cooper Power Systems*, Jun. 1997, pp. 1-4.
"Loadbreak Apparatus Connectors, 200 A 15 kV Class Loadbreak Bushing Insert 500-12," *Cooper Power Systems*, Nov. 1995, pp. 1-2.
"T-OP™ II: How Many Sticks Does It Take To Operate Your 600 Amp Terminator System?," *Cooper Power Systems*, Jul. 1994, 4 pages.
"Installation & Operation Instructions 168ALR, Access Port Loadbreak Elbow Connectors"; *Elastimold IS-168ALR* (*Rev C*); pp. 1-5; (Feb. 1, 1994).
"Operating Instructions 200TC-2"; *Elastimold IS-200TC* (*Rev-A*); pp. 1-2; (Feb. 26, 1995).
"Surge Arresters"; *Elastimold Catalog*; pp. 26-27; (2001).
"Surge Arresters, Metal Oxide Varistor elbow (M.O.V.E.™) Surge Arrester Electrical Apparatus 235-65"; *Cooper Power Systems*; pp. 1-4; Dec. 2003.
"Surge Arresters, Metal Oxide Elbow Surge Arrester Electrical Apparatus 235-65"; *Cooper Power Systems*; pp. 1-4; Jan. 1991.

"Surge Arresters, Metal Oxide Varistor (MOV) Parking Stand Surge Arrester Electrical Apparatus 235-68"; *Cooper Power Systems*; pp. 1-3; Apr. 2002.
"INJPLUG35, 35 kV Amp Loadbreak Injection Plug Operating and Installation Instructions"; *Cooper Power Systems*; p. 1; (Sep. 2002).
"Loadbreak Apparatus Connectors, 200 A 15 kV Class Loadbreak Elbow Connector, Electrical Apparatus 500-10"; *Cooper Power Systems*; pp. 1-4; (Feb. 2004).
"Loadbreak Apparatus Connectors, 200 A 15 kV and 25 kV Class Elbow Installation Instructions, Service Information S500-10-1"; *Cooper Power Systems*; pp. 1-4; (Feb. 2001).
"Loadbreak Apparatus Connectors, 200 A 15kV Class Loadbreak Bushing Insert 500-12"; *Cooper Power Systems*; pp. 1-2; (Nov. 1995).
"Loadbreak Apparatus Connectors, 200 A 15kV Class Loadbreak Rotatable Feedthru Insert; Electrical Apparatus 500-13"; *Cooper Power Systems*; pp. 1-2; (Apr. 2001).
"Loadbreak Apparatus Connectors, 200 A 25 kV Class—Expanded Range Loadbreak Elbow Connector, Electrical Apparatus 500-28"; *Cooper Power Systems*: pp. 1-4; (Jan. 2004).
"Loadbreak Apparatus Connectors, 200 A 25 kV Class Rotatable Feedthru Insert, Electrical Apparatus 500-30"; *Cooper Power Systems*; pp. 1-2; (Jun. 1999).
"Loadbreak Apparatus Connectors, 200 A 35 kV Class Three-Phase Loadbreak Injection Elbow Installation Instructions, Service Information S500-55-2"; *Cooper Power Systems*; pp. 1-6; (Apr. 1999).
Cooper Power Systems, *Deadbreak Apparatus Connectors*, "600 A 15/25 kV Clas Bol-T™ Deadbreak Connector", Electrical Apparatus 600-30, pp. 1-6, Feb. 2003.
Cooper Power Systems, *Deadbreak Apparatus Connectors*, "600 A 15/25 kV Class PUSH-OP® Deadbreak Connector", Electrical Apparatus 600-33, pp. 1-4, Nov. 2004.
Cooper Power systems, *Molded Rubber Products*, "600 A 15/25 kV Class T-OP™ II Deadbreak Connector", Electrical Apparatus 600-32, pp. 1-4, Jul. 2005.
Cooper Power Systems, *OEM Equipment*, "Four-Position Sectionalizing Loadbreak Switches", Electrical Apparatus 800-64, pp. 1-8, Dec. 2003.
Elastimold Product Selection Guide, Cable Accessories, PG-CA-0307, "For 5kV-35kV Distribution Systems, Loadbreak & Deadbreak Separable Connectors, Cable Joints, Cable Terminations", Thomas & Betts Corporation, © 2007, 44 pages.
Loadbreak Apparatus Connectors Service Information 500-26, Cooper Power Systems, May 2003, Waukesha, WI.
Deadbreak Apparatus Connectors Electrical Apparatus, Cooper Power Systems, Jul. 1999, Marketing Material.
Installation Instructions, 650LK-B Link Operable Connector System (Bolted) May 1, 1989.
G&W Electric Co.; "Breakthrough in Switching Technology; Solid Dielectric Switchgear"; Oct. 2001; Blue Island, IL. cited by other.
Cooper Power Systems; "Padrnounted Switchgear; Type RVAC, Vacuum-Break Switch, Oil-Insulated or SF.sub.6-Insulated; Electrical Apparatus 285-50"; Jul. 1998. cited by other.

* cited by examiner

MEDIUM VOLTAGE SEPARABLE INSULATED ENERGIZED BREAK CONNECTOR

BACKGROUND OF THE INVENTION

The invention relates generally to cable connectors for electric power systems, and more particularly to separable insulated connector systems for use with medium and high voltage cable distribution systems.

Electrical power is typically transmitted from substations through cables which interconnect other cables and electrical apparatus in a power distribution network. The cables are typically terminated on bushings that may pass through walls of metal encased equipment such as capacitors, transformers or switchgear. Such cables and equipment transmit electrical power at medium and high voltages generally greater than 600V.

Separable connector systems have been developed that allow ready connection and disconnection of the cables to and from the electrical equipment. In general, two basic types of separable connector systems have conventionally been provided, namely deadbreak connector systems and loadbreak connector systems.

Deadbreak connector systems require connection or disconnection of cables while the equipment and the cables are de-energized. That is deadbreak connectors are mated and separated only when there is no voltage and no load current between the contacts of the connectors and the bushings of the equipment. Deadbreak connector systems for high voltage equipment are typically rated for currents of about 600 A.

To avoid power interruptions required by deadbreak connector systems, loadbreak connector systems have been developed that allow connection and disconnection to equipment under its operating voltage and load current conditions. Loadbreak connector systems, however, are typically rated for much lower currents of about 200 A in comparison to deadbreak connector systems.

DETAILED DESCRIPTION OF THE INVENTION

Exemplary embodiments of inventive medium and high voltage separable insulated connector systems are described herein below that are operable in deadfront, solid dielectric switchgear and other solid dielectric insulated electrical equipment at higher current ratings than loadbreak connector systems. The connectors may be provided at relatively low cost, and facilitate installation and removal of protection modules to the equipment without having to power down the equipment, but in a different manner from conventional loadbreak connector systems. The inventive connector systems are sometimes referred to as energized break connectors, which shall refer to the making and breaking of electrical connections that are energized at their rated voltage, but not carrying load current. Such conditions may occur, for example, when protective elements such as fuses and the like operate to interrupt electrical current through a portion of the electrical equipment. The separable energized break connector systems of the invention permit the protection modules to be replaced while the equipment is energized and still in service.

In order to understand the invention to its fullest extent, the following disclosure will be segmented into different parts or sections, wherein Part I discusses exemplary switchgear and electrical equipment, as well as conventional connector systems therefore, and Part II describes exemplary embodiments of connectors formed in accordance with an exemplary embodiment of the invention.

I. INTRODUCTION TO THE INVENTION

In order to fully appreciate the inventive energized break connector systems described later below, some appreciation of electrical equipment, and different types of conventional connectors, namely loadbreak and deadbreak connector systems for such electrical equipment, is necessary.

A. The Electrical Equipment

Figure 1:
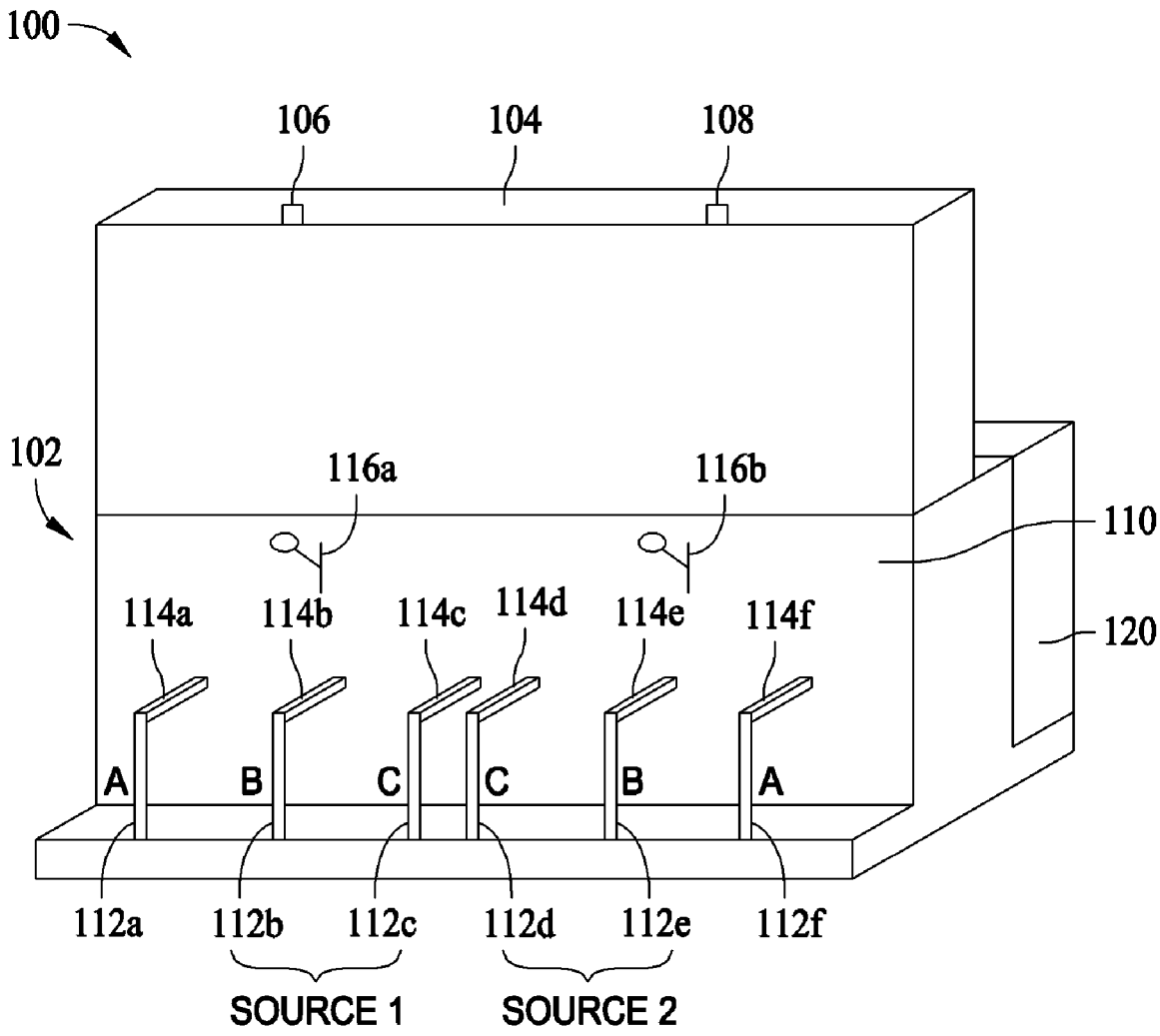
FIG. 1 Prior Art
FIG. 1 is a perspective view of electrical switchgear in accordance with an exemplary embodiment of the present invention viewed from a source side of the switchgear.

FIG. 1 illustrates an exemplary electrical equipment configuration 100 with which the connectors of the invention, described below, may be used. While in an exemplary embodiment the electrical equipment 100 is a particular configuration of switchgear, it is understood that the benefits of the invention accrue generally to switchgear of many configurations, as well as electrical equipment of different types and configurations, including but not limited to a power distribution capacitor or transformer. That is, the switchgear 100 is but one potential application of the inventive connector assemblies and systems described hereinbelow. Accordingly, the switchgear 100 is illustrated and described herein for illustrative purposes only, and the invention is not intended to be limited to any particular type of switchgear configuration, such as the switchgear 100, or to any particular type of electrical equipment.

Figure 2:
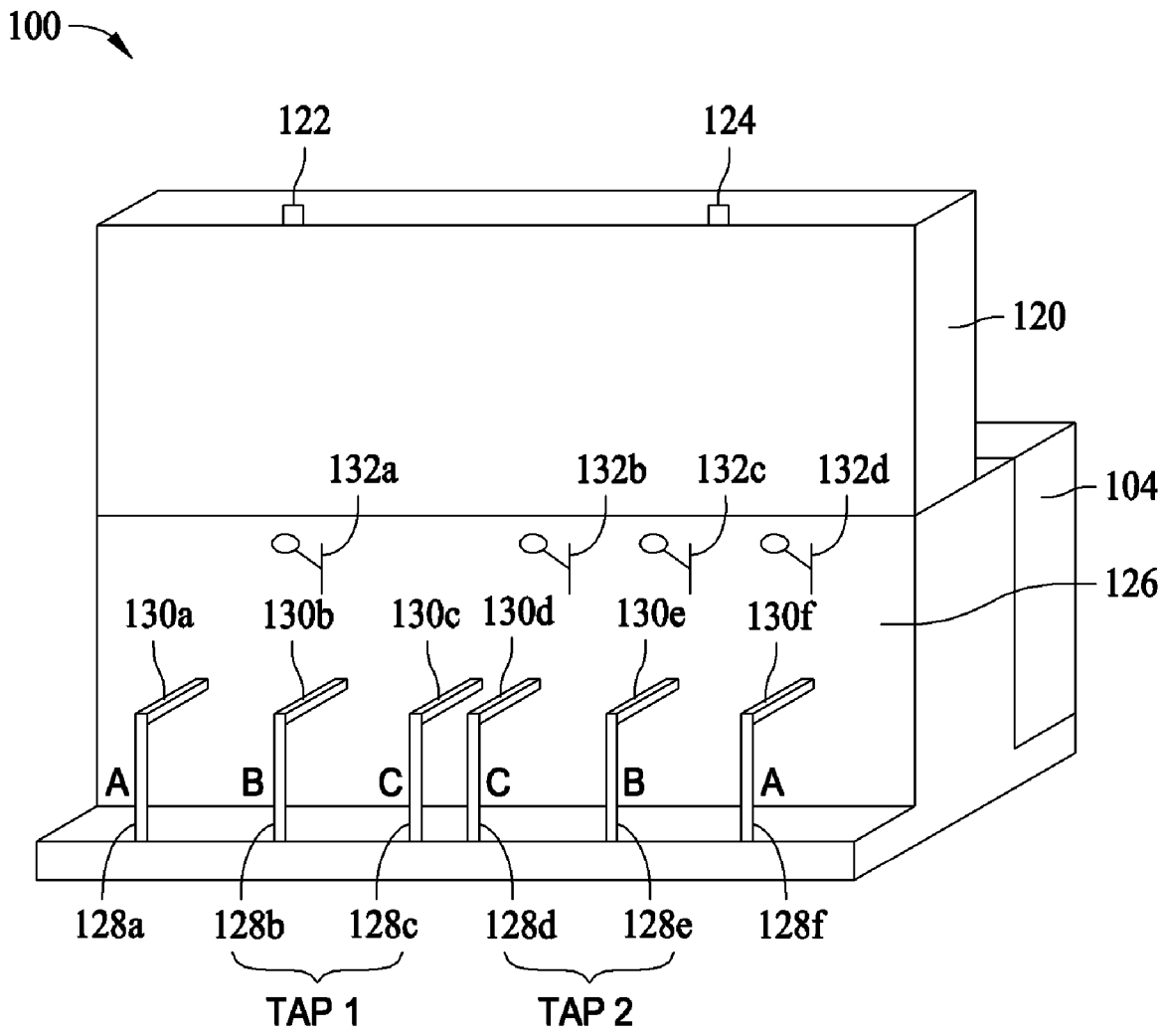
FIG. 2 Prior Art
FIG. 2 is another perspective view of the switchgear shown in FIG. 1 viewed from a tap side of the switchgear.

As shown in FIG. 1, the switchgear 100 includes a protective enclosure 102 having, for example, a source side door 104 positionable between an open position (FIG. 1) and a closed position (FIG. 2). Latch elements 106 and/or 108 may be used to lock source side door 104 in a closed position. Inside the source side door 104 is a front plate 110 that forms a portion of the enclosure 102. Cables 112*a*-112*f* may be coupled to a lower end of the enclosure 102 and are connected to active switching elements (described below) in the enclosure 102, and each of the cables 112*a*-112*f* typically carry power in three phases from two different sources. For example, cables 112*a*-112*c* may carry, respectively, the A, B and C phases of power from source 1, and cables 112*d*-112*f* may carry, respectively, the C, B and A phases of power from source 2.

Cables 112*a*-112*f* may be coupled to the front-plate 110 and switchgear 100 through, for example, connector components 114*a*-114*f* that join the cables 112*a*-112*f* to respective switching elements (not shown in FIG. 1) in the enclosure

102. The switching elements may, in turn, be coupled to an internal bus bar system (not shown in FIG. 1) in the enclosure 102.

Handles or levers 116*a* and 116*b* are coupled to the enclosure 102 and may operate active switchgear elements (described below) inside the switchgear 100 to open or interrupt the flow of current through the switchgear 100 via the cables 112*a*-112*f* and electrically isolate power sources 1 and 2 from load-side or power receiving devices. The cables 112*a*-112*c* may be disconnected from the internal bus bar system by manipulating the handle 116*a*. Similarly, cables 112*d*-112*f* may be disconnected from the internal bus bar system by manipulating the handle 116*b*. Handles 116*a* and 116*b* are mounted onto the front-plate 110 as shown in FIG. 1. In an exemplary embodiment, the active switch elements on the source side of the switchgear 100 are vacuum switch assemblies (described below), and the vacuum switch assemblies may be used in combination with other types of fault interrupters and fuses in various embodiments of the invention.

One exemplary use of switchgear is to segregate a network of power distribution cables into sections such as, for example, by opening or closing the switch elements. The switch elements may be opened or closed, either locally or remotely, and the power supplied from one source to the switchgear may be prevented from being conducted to the other side of the switchgear and/or to the bus. For example, by opening the switch levers 116*a* and 116*b*, power from each of the sources 1 and 2 on one side of the switchgear is prevented from being conducted to the other side of the switchgear and to the bus and the taps. In this manner, a utility company is able to segregate a portion of the network for maintenance, either by choice, through the opening of switchgear, or automatically for safety, through the use of a fuse or fault interrupter, depending on the type of active switching elements included in the switchgear.

FIG. 2 illustrates another side of the switchgear 100 including a tap side door 120 that is positionable between open (shown in FIG. 2) and closed (FIG. 1) positions in an exemplary embodiment. Latch elements 122 and/or 124 may be used to lock the tap side door 120 in the closed position. Inside the tap door 120 is a front-plate 126 that defines a portion of the enclosure 102. Six cables 128*a*-128*f* may be connected to a lower side of the switchgear 100, and each of the respective cables 128*a*-128*f* typically carries, for example, one phase of power away from switchgear 100. For example, cable 128*a* may carry A phase power, cable 128*b* may carry B phase power and cable 128*c* may carry C phase power. Similarly, cable 128*d* may carry C phase power, cable 128*e* may carry B phase power and cable 128*f* may carry A phase power. Connectors 130*a*-130*f* connect cables 128*a*-128*f* to switchgear.

It should be noted that the exemplary switchgear 100 in FIGS. 1 and 2 shows one only one exemplary type of phase configuration, namely an ABC CBA configuration from left to right in FIG. 2 so that the corresponding cables 128*a*-128*c* and 128*d*-128*f* carry the respective phases ABC and CBA in the respective tap 1 and tap 2. It is understood, however, that other phase configurations may be provided in other embodiments, including but not limited AA BB CC so that cables 128*a* and 128*b* each carry A phases of current, cables 128*c* and 128*d* each carry B phases of current, and so that cables 128*e* and 128*f* each carry C phases of current. Still other configurations of switchgear may have one or more sources and taps on the same front-plate 110 (FIG. 1) or 126 (FIG. 2), or on the sides of the switchgear on one or more additional front plates. It also contemplated that each phase may be designated by a number, such as 1, 2 and 3, and that the switchgear may accommodate more or less than three phases of power. Thus, a switchgear may have, for example only, a configuration of 123456 654321 on the tap side of the switchgear 100.

A frame may be positioned internal to the switchgear and provide support for the active switching elements as well as the bus bar system, described below. In other words, the frame holds the active switching elements and bus bar system in place once they are coupled to the frame. The frame is oriented to allow portions of the active switching elements, typically bushings, to protrude as a bushing plane so that connections to the various cables can be made.

In an exemplary embodiment, a lever or handle 132*a* operates active switchgear elements, as described below, inside the switchgear 100 to disconnect cables 128*a*, 128*b*, 128*c* from the internal bus bar system. Similarly, handles 132*b*-132*d* cause one of individual cables 128*d*, 128*e*, 128*f* to disconnect and connect, respectively, from the internal bus bar system. In an exemplary embodiment, the active switchgear elements on the tap side of the switchgear 100 include vacuum interrupter assemblies (described below), and the vacuum interrupter assemblies may be used in combination with fuses and various types of fault interrupters in further and/or alternative embodiments of the invention.

Figure 3:
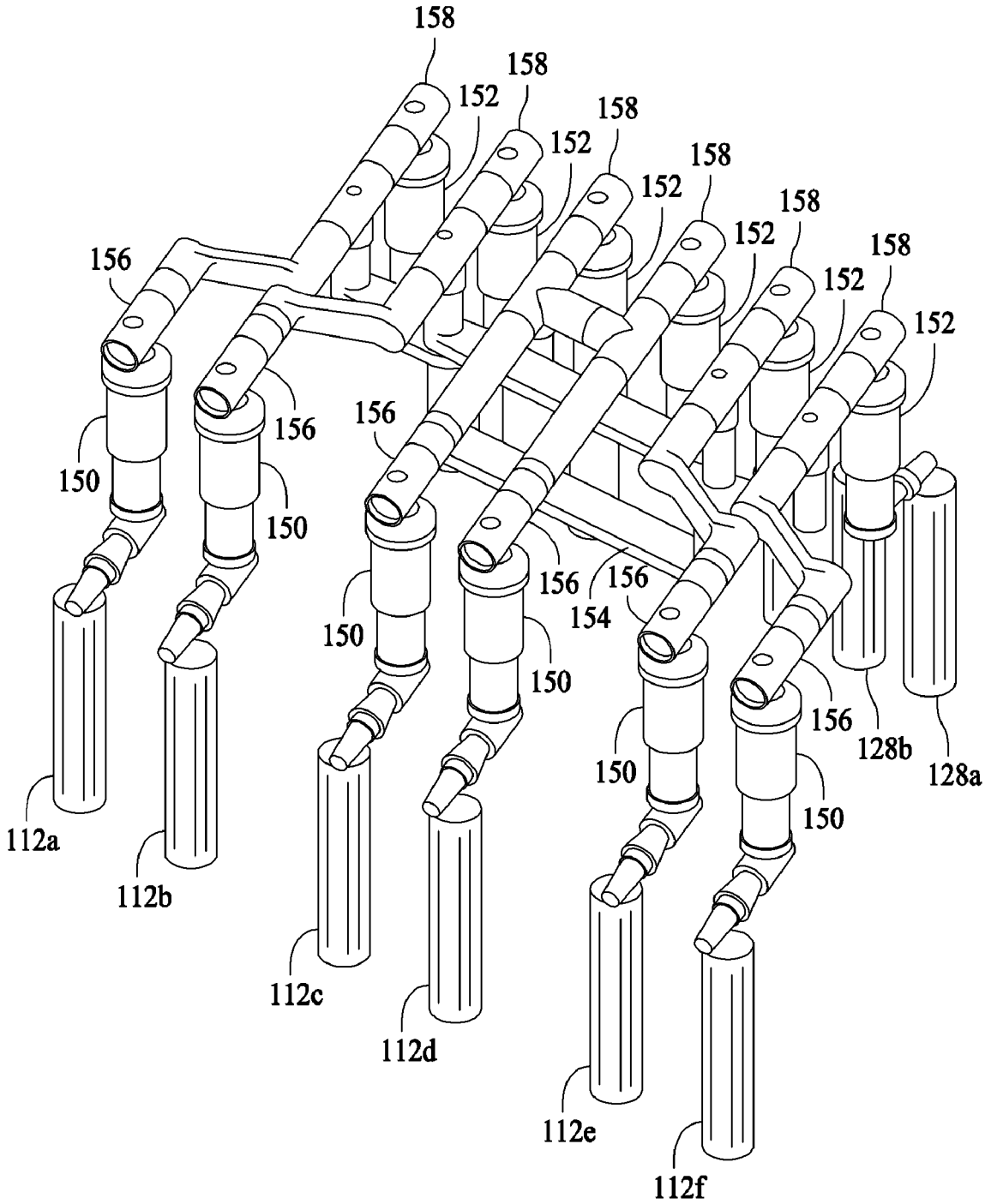
FIG. 3 Prior Art
FIG. 3 is a perspective view of internal components of the switchgear shown in FIGS. 1 and 2.

FIG. 3 is a perspective view of exemplary internal components of the switchgear 100 removed from the enclosure 102 and without the supporting frame. Switch element assemblies 150 and protective element assemblies 152 such as fuses, breakers, interrupter assemblies and the like may be positioned on opposites sides (i.e., the source side and the tap side, respectively) of the switchgear assembly. The switch element assemblies 150 and the protective element assemblies 152 may include solid dielectric insulation, and the switchgear may be configured as a deadfront apparatus, as opposed to livefront apparatus, has no exposed voltage on the exterior of the enclosure 102 and therefore provides increased, safety for both the apparatus operator and the public.

Cables 112*a*-112*f* may be connected to respective switch element assemblies 150, and cables 128*a*-128*f* (cables 128*c*-128*f* not labeled in FIG. 3) may be connected to the respective interrupter element assemblies 152.

A bus bar system 154 may be situated in between and may interconnect the switch element or interrupter assemblies 150 and 152 via connectors 156 and 158. The bus bar system 154 may be, for example, a modular cable bus and connector system having solid dielectric insulation. The modular cable bus system may be assembled with mechanical and push-on connections into various configurations, orientations of phase planes, and sizes of bus bar systems using, for example, molded solid dielectric bus bar members to facilitate various configurations of bus bar systems with a reduced number of component parts. In other embodiments, other known bus bar systems may be employed as those in the art will appreciate.

When certain types of protective elements 152 are utilized in the switchgear, it may be necessary to replace the protective elements 152 as they operate to interrupt the circuit path. In particular, when fuses are utilized in the elements 152 and the fuse elements open a current path through the respective protective element 152, the fuse elements must be removed and replaced to restore the respective electrical connections through the fuses. In such circumstances, an opened fuse remains at its operating voltage potential or rated voltage, but carries no load current because the current path through the fuse is opened. An opened fuse or fuses in the respective protective elements 152 may impair the full power service of the switchgear to some degree by interrupting or reducing power supply to loads and equipment directly connected to the opened fuse(s), while protective elements 152 that have not opened may continue to supply electrical power to other electrical loads and equipment.

Conventionally, the entire switchgear is de-energized or switched off so that fuse modules may be removed and replaced in such circumstances. When the entire switchgear is de-energized, power loss will occur to downstream circuits and loads that may otherwise be unaffected by an opened fuse in the switchgear. Power losses to downstream circuit, equipment and devices, and particularly power loss to utility customers is undesirable, and it would be beneficial to provide the capability to remove and replace the protective elements 152 without de-energizing or switching off the entire switchgear. Known connectors are not suitable for such purposes.

B. Conventional Loadbreak Connector Systems

Figure 4:
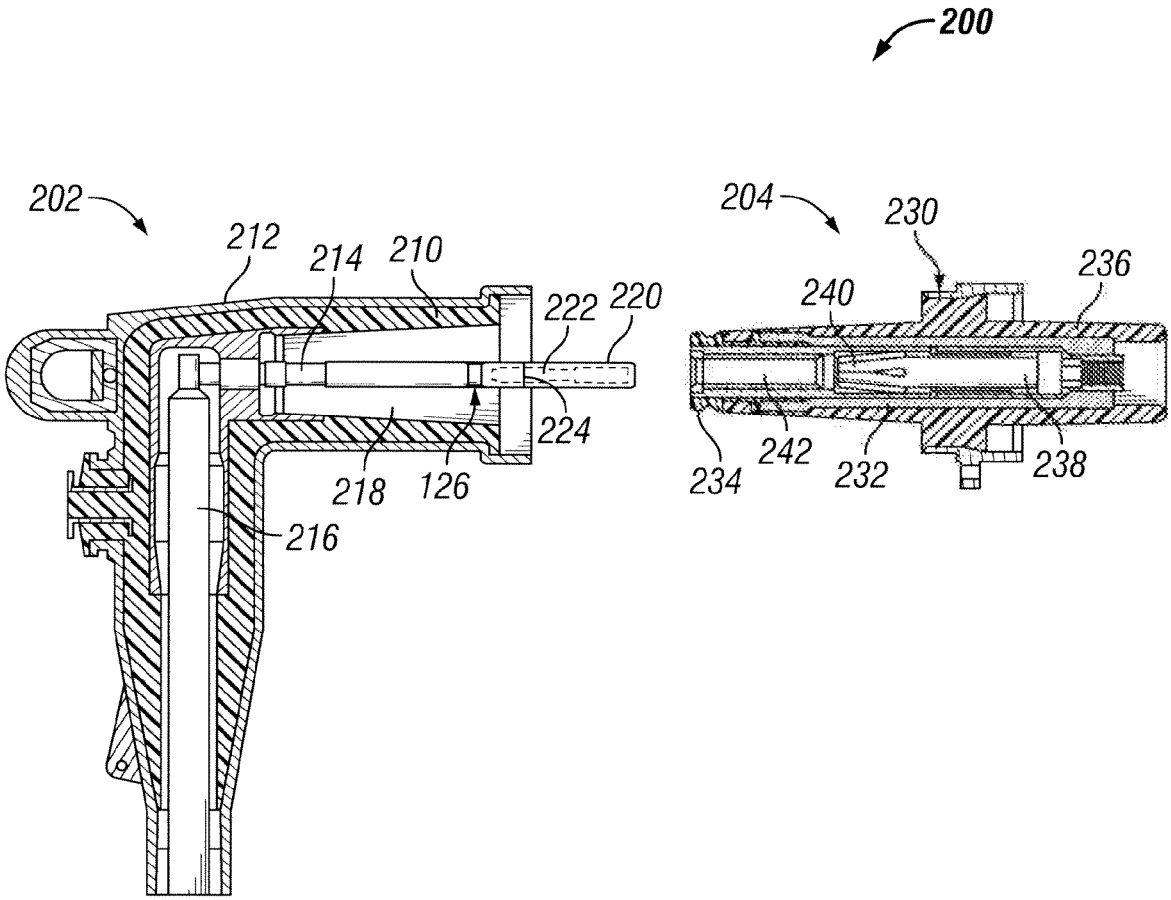
FIG. 4 (Prior Art)
FIG. 4 is a longitudinal cross-sectional view of a known separable loadbreak connector system.

FIG. 4 is a longitudinal cross-sectional view of a conventional separable loadbreak connector system 200 that may be utilized to connect and disconnect cables to the switchgear 100 under energized circuit conditions at rated voltage and under electrical load current conditions.

As shown in FIG. 4, the load break connector system 200 includes a male connector 202 and a female connector 204. The female connector 204 may be, for example, a bushing insert or connector connected to the switchgear 100, for example, or another electrical apparatus such as a capacitor or transformer, and the male connector 202, may be, for example, an elbow connector, electrically connected to a respective one of the cables 112 (FIGS. 1 and 3). The male and female connectors 202, 204 respectively engage and disengage one another to achieve electrical connection or disconnection to and from the switchgear 100 or other electrical apparatus.

While the male connector 202 is illustrated as an elbow connector in FIG. 4, and while the female connector 204 is illustrated as a bushing insert, the male and female connectors may be of other types and configurations known in the art.

In an exemplary embodiment, and as shown in FIG. 4, the male connector 202 may include an elastomeric housing 210 of a material such as EPDM (ethylene-propylene-dien-emonomer) rubber which is provided on its outer surface with a conductive shield layer 212 which is connected to electrical ground. One end of a male contact element or probe 214, of a material such as copper, extends from a conductor contact 216 within the housing 210 into a cup shaped recess 218 of the housing 210. An arc follower 220 of ablative material, such as cetal co-polymer resin loaded with finely divided melamine in one example, extends from an opposite end of the male contact element 214. The ablative material may be injection molded on an epoxy bonded glass fiber reinforcing pin 222. A recess 224 is provided at the junction between metal rod 214 and arc follower 220. An aperture 226 is provided through the exposed end of rod 214 for the purpose of assembly.

The female connector 204 may be a bushing insert composed of a shield assembly 230 having an elongated body including an inner rigid, metallic, electrically conductive sleeve or contact tube 232 having a non-conductive nose piece 234 secured to one end of the contact tube 232, and elastomeric insulating material 236 surrounding and bonded to the outer surface of the contact tube 232 and a portion of the nose piece 234. The female connector 204 may be electrically and mechanically mounted to the enclosure of the switchgear 100 or a transformer or other electrical equipment.

A contact assembly including a female contact 238 having deflectable contact fingers 240 is positioned within the contact tube 232, and an arc interrupter 242 is provided proximate the female contact 238.

The male and female connectors 202, 204 are operable or matable during "loadmake", "loadbreak", and "fault closure" conditions. Loadmake conditions occur when the one of the contact elements, such as the male contact element 214 is energized and the other of the contact elements, such as the female contact element 238 is engaged with a normal load. An arc of moderate intensity is struck between the contact elements 214, 238 as they approach one another and until joinder under loadmake conditions. Loadbreak conditions occur when the mated male and female contact elements 214, 238 are separated when energized and supplying power to a normal load. Moderate intensity arcing again occurs between the contact elements 214, 238 from the point of separation thereof until they are somewhat removed from one another. Fault closure conditions occur when the male and female contact elements 214, 238 are mated with one of the contacts being energized and the other being engaged with a load having a fault, such as a short circuit condition. Substantial arcing occurs between the contact elements 214, 238 in fault closure conditions as the contact elements approach one another they are joined. In accordance with known connectors of this type, the female contact 238 may be released and accelerated, due to buildup of rapidly expanding gas in a fault closure condition, in the direction of the male contact element 240 as the connectors 202, 204 are engaged during fault closure conditions, thus minimizing arcing time and hazardous conditions.

An arc-ablative component, such as the arc follower 220, is required in one or both of the connectors 202 and 204 to produce an arc extinguishing gas during loadbreak switching for enhanced switching performance. Such arc-ablative components, result in two piece contact probes, with one piece being formed of conductive metal and the other being formed from a nonconductive material such as plastic, to define the arc-ablative component. While the metal portion of the probe is structurally strong and robust, the plastic portion is structurally much weaker. This presents a vulnerability in the contact probe if, as is sometimes the case, a worker attempts to use the contact probe as a wedge or lever to manipulate a heavy cable into position with respect to the mating connector and electrical equipment. Breakage of the arc-ablative component may result in such conditions, leading to impaired operation of the loadbreak connector system and reliability issues. Additionally, breakage of arc ablative components may present a hazard to an operator.

Figure 5:
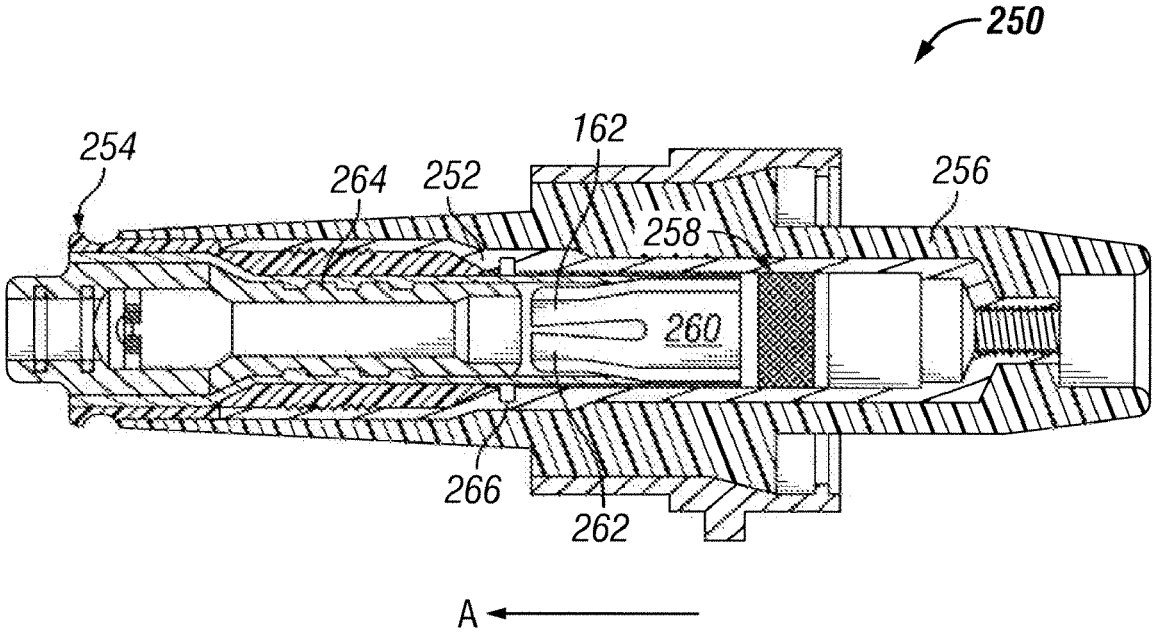
FIG. 5 (Prior Art)
FIG. 5 is an enlarged cross-sectional view of a known female contact connector that may be used in the loadbreak connector system shown in FIG. 4.

FIG. 5 illustrates another conventional female connector 250 that may be used in the connector system 200 (FIG. 4) in lieu of the female connector 204. Like the connector 204, the female connector 250 includes an elongated body including an inner rigid, metallic, electrically conductive sleeve or contact tube 252 having a non-conductive nose piece 254 secured to one end of the contact tube 252, and elastomeric insulating material 256 surrounding and bonded to the outer surface of the contact tube 252 and a portion of the nose piece 254.

A contact assembly includes a piston 258 and a female contact element 260 having deflectable contact fingers 262 is positioned within the contact tube 252 and an arc interrupter 264 is provided proximate the female contact 260. The piston 258, the female contact element 260, and the arc interrupter 264 are movable or displaceable along a longitudinal axis of the connector 250 in the direction of arrow A toward the male contact element 214 (FIG. 4) during a fault closure condition. To prevent movement of the female contact 260 beyond a predetermined amount in the fault closure condition, a stop ring 266 is provided, typically fabricated from a hardened steel or other rigid material.

Loadbreak connector systems can be rather complicated in their construction, and are typically provided with current ratings of about 200 A or below due to practical limitations in making and breaking connections carrying load current. Also, the load break, load make and fault closure features of such connectors, such as the arc-ablative components, are of no practical concern for applications such as that described above wherein removal and replacement of fuse modules involves making and breaking of connections under energized circuit conditions at rated voltage, but not under load current conditions. Cost associated with such load break, load make and fault closure features in applications wherein load current is not present is therefore of little to no value. It would be desirable to provide lower cost connector systems with significantly higher current ratings than known loadbreak connector systems can provide making and breaking of connections under energized circuit conditions at rated voltage, but not under load current conditions.

C. Conventional Deadbreak Connector Systems

Figure 6:
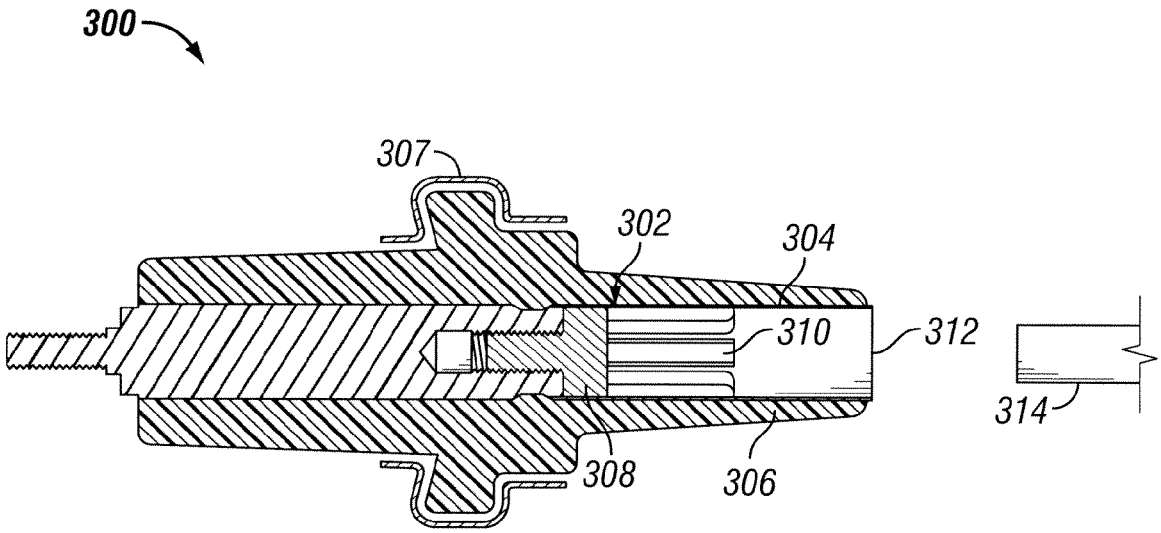
FIG. 6 (Prior Art)
FIG. 6 is a cross sectional view of a separable deadbreak connector formed in accordance with an exemplary embodiment of the invention.

FIG. 6 is a cross sectional schematic view of an exemplary conventional female connector 300 of a deadbreak connector system. As shown in FIG. 6 the female connector 300 may be a bushing composed of a shield assembly 302 having an elongated body including an inner rigid, metallic, electrically conductive sleeve or shield housing 304 and insulating material 306, which may be an elastomeric or epoxy insulation, for example, surrounding and bonded to the outer surface of the shield housing 304. A conductive ground plane 307 may be provided on an outer surface of the housing 306. The female connector 300 may be electrically and mechanically mounted to the enclosure of the switchgear 100 or other electrical equipment.

A contact assembly including a female contact 308 having deflectable contact fingers 310 is positioned within the shield housing 304. Unlike the loadbreak connector system previously described, the contact 308 is fixedly secured and is not movable relative to the shield housing 304. Also as shown in FIG. 6, conductive portions of the connector 300 are generally exposed at and end 312 of the connector. In particular, the end of the shield housing 304, which in use is at the operating voltage potential of the female contact 308, is generally exposed at the end 312 of the connector 304.

Because conductive components of the connector are exposed at the connector end 312, if subjected to large operating voltages in the absence of load current conditions as described above when a fuse element operates, voltage flashover may occur between the exposed conductive components and a male contact probe 314 of a mating connector as the connectors are separated or mated. Voltage flashover may also occur from the exposed conductive components at the connector end 312 to the connector ground plane 307. Such flashover may present hazardous conditions and is undesirable.

II. SEPARABLE INSULATED CONNECTOR SYSTEMS OF THE INVENTION

Figure 7:
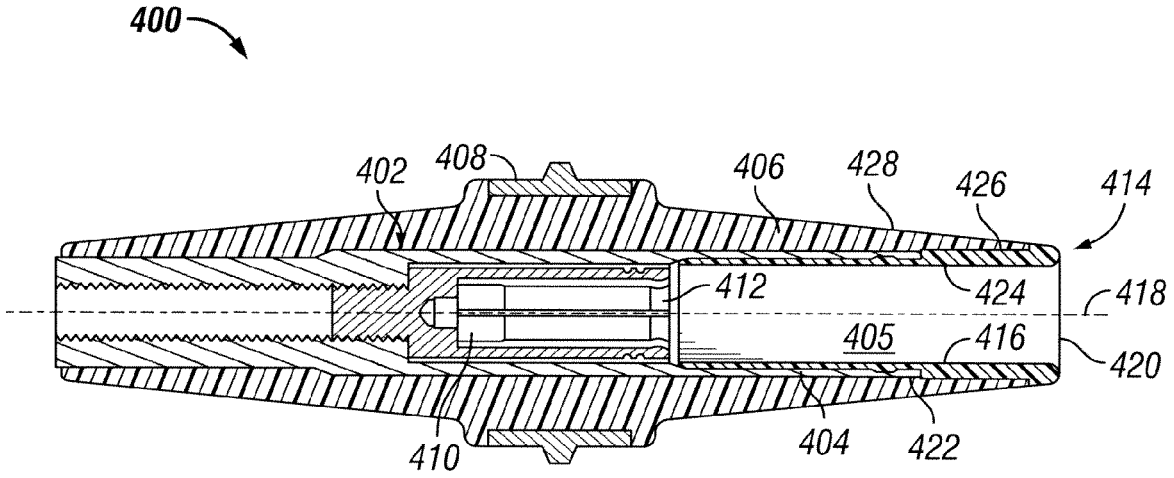
FIG. 7 is a cross sectional view of an energized break female connector formed in accordance with an exemplary embodiment of the invention.

FIG. 7 is a cross sectional view of an energized break female connector 400 formed in accordance with an exemplary embodiment of the invention and that overcomes the various problems and difficulties discussed above in Part I. As used, herein, "energized break" shall refer to energized circuit conditions wherein rated voltage potential exists but load current does not exist due to, for example, a protective element such as a fuse opening a current path. The connector 400 may be provided at relatively low cost and with much higher current ratings than known separable loadbreak connector systems, and may capably facilitate replacement of fuse modules and the like under rated voltage without de-energizing associated electrical equipment, such as the switchgear 100 described above. It is recognized, however, that the description and figures set forth herein are set forth for illustrative purposes only, and that the benefits of the invention may accrue to other types of electrical equipment. The illustrated embodiments of switchgear and inventive connectors are merely exemplary configurations of devices and equipment embodying the inventive concepts of the present invention.

Likewise, while the energized break connector 400 is described and depicted herein having a particular configuration with certain attributes, materials, shape and dimension, it is understood that various embodiments having other, materials, shape and dimension may likewise be constructed within the scope and spirit of the invention.

As shown in FIG. 7, the female connector 400 may be a bushing insert having of a shield assembly 402 formed with an elongated body including an inner rigid, metallic, electrically conductive sleeve or shield housing 404 defining an axial passage 405, and insulating material 406, which may be an elastomeric material or another insulating material, forming a housing surrounding and bonded to the outer surface of the shield housing 404. While the connector is illustrated with a particular shape of shield housing 404 and housing 406, other shapes of these components may also be utilized as desired.

A conductive ground plane 408 may be provided on an outer surface of the housing 406 for safety reasons. The female connector 400 may be electrically and mechanically mounted to the enclosure of the switchgear 100 or other electrical equipment. Alternatively, the female connector may be utilized for other purposes.

A contact assembly including a female contact 410 having deflectable contact fingers 412 is positioned within the shield housing 404. While a particular type and shape of contact 410 is illustrated, it is recognized that other types of contacts may be utilized. The shield housing 404 provides a faraday cage which has the same electric potential as the contact 410. The faraday cage prevents corona discharges within the connector as it is mated, for example, to a mating connector. The contact assembly, in one embodiment, may be constructed to adequately make and break a high voltage connection of, for example, greater than 10 kV, although the connector in other embodiments may be constructed to make and break connections at or below 10 kV as desired.

Like the deadbreak connector system 300 (FIG. 6) previously described, the contact 410 is fixedly secured and is not movable relative to the shield housing 404 in any operating condition, in specific contrast to the loadbreak connector 204 and 250 (FIGS. 4 and 5) having a movable contact assembly during fault closure conditions. Unlike either of the loadbreak and deadbreak connectors previously described, the energized break connector 400 includes a continuous, uninterrupted insulation system 414 extending from the contact fingers 412 to the ground plane 408 on the outer surface of the housing 406.

The insulation system 414 includes a nonconductive nosepiece 416 and a portion of the housing 406 as described below. The nosepiece 416 extends substantially an entire distance along an axis 418 of the connector from the contact fingers 412 to a distal open end 420 of the connector that receives a male contact probe of a mating connector (not shown in FIG. 7). The nosepiece 416 may be fabricated from a nonconductive material such as nylon in an exemplary embodiment, although other materials may likewise be used to form the nosepiece 416.

In one embodiment, the nosepiece 416 may mechanically engage the shield housing 404 with snap fit engagement. In another embodiment, threads and other fasteners, including adhesives and the like, may be utilized to attach to the nosepiece 414 to the shield housing 404 and/or another component of the connector 400. In still another embodiment, the nosepiece 416 may be molded, such as with an overmolding process, into the connector construction if desired to form a full, surface-to-surface chemical bond between the nosepiece 416 and the shield housing 404 that is free of any air gaps or voids between the interface of the nosepiece 416 and the shield housing 404. Also in an exemplary embodiment, the nosepiece 416 may be overmolded with insulating material to form the housing 406, resulting in a full chemical bond between the nosepiece 416 and the housing 406 without air gaps or voids. While overmolding is one way to achieve a full surface-to-surface bond between the shield housing 404 and the nosepiece 416 without air gaps, and also a full surface-to-surface bond between the nosepiece 416 and the housing 406, it is contemplated that a voidless bond without air gaps could alternatively be formed in another manner, including but not limited to other chemical bonding methods and processes aside from overmolding, mechanical interfaces via pressure fit assembly techniques and with collapsible sleeves and the like, and other manufacturing, formation and assembly techniques as known in the art.

In one exemplary embodiment, the nosepiece 416 may be shaped or otherwise formed into a substantially cylindrical body that overlaps an substantially covers an interior surface of the shield housing 404 for an axial distance along the axis 418 from a point proximate or adjacent to the contact fingers 412 to a distal end 422 of the shield housing 404, and also extends an axial distance from shield housing end 422 to the distal open end 420 of the connector. The housing 406 also extends well beyond the distal end 422 of the shield housing 404 and overlies an exterior surface of a portion of the nosepiece 416 extending forwardly of the distal end 422 of the shield housing.

An inner surface 424 of the nosepiece may be generally smooth and constant in dimension, and defines a continuously insulated path from the end of the contact fingers 412 along the passage 405 of the shield housing 404 to the distal end 420 of the connector 400. An exterior surface 426 of the nosepiece may be irregular in shape, and may include a first portion of a relatively larger outer diameter that meets a portion of the housing 406 adjacent the distal end 420, and a portion of relatively smaller outer diameter that is received within the shield housing 404 and provides an insulative barrier on the inner surface of the shield housing 404.

While an exemplary shape of the nosepiece 416 has been described having portions of different diameters and the like, it is recognized that the nosepiece may be alternatively shaped and formed in other embodiments, while still achieving the benefits of the invention.

The extension of the nosepiece 416 and the housing 406 beyond the distal end 422 of the shield housing 404 effectively spaces the female contact 410, and particularly the contact fingers 412, farther from the distal end 420 of the connector 400. In other words, the extension of the nosepiece 416 and the housing 406 results in the female contact being further recessed in the shield housing 404 relative to the end 420 of the connector. This accordingly mitigates flashover between the contact fingers 412 and the distal end 420 of the connector 400 when the female connector 400 is engaged to or separated from a male contact probe of a mating connector, which may be the male connector of a fuse module in the electrical equipment. The non-conductive nosepiece 416 and the extended housing 406 fully insulate the distal end 420 of the connector 400 such that no conductive component is exposed proximate the distal end 420. Flashover at, for example, the distal end 420 of the shield housing 404 is accordingly avoided.

Extension of the housing 406 to meet the extended nosepiece 416 at a distance from the end 422 of the shield housing also effectively increases a path length on the outer surface of the connector interface 428 between the connector distal end 420 and the ground plane. The increased path length along the inner surface 424 of the nosepiece 416 and the increased path length on the outer surface of the interface 428 of the housing 406 is believed to substantially reduce, if not altogether eliminate, instances of flashover between the contact fingers 412 and the ground plane 408. The longer interface creep distance also yields better static dielectric performance of the connector 400.

As is also clear from FIG. 7, the nosepiece 416 and/or the housing 406 are devoid of any venting features, arc ablative components, and the like that are common to loadbreak connector systems for releasing arc quenching gases and the like. That is, no air gaps or passages for gas are formed into the energized break connector construction, and instead the insulative nosepiece 416 and the housing 406 are uniformly constructed in a solid manner without discontinuities, openings, gaps or spaces formed therein and therebetween that may otherwise present voltage tracking and flashover concerns. Arc-ablative components are not required, resulting in a rigid and unitary contact probe structure that is not as prone to breakage as two piece probe assemblies utilized in loadbreak connectors as described above.

By virtue of the above-described construction, the connector 400 may enjoy current ratings up to, for example, 900 A in an economical and easy to manufacture platform. The energized break separable connector 400 is matable to and separable from a mating connector with rated voltage between the connector contacts but without load current, and may effectively allow replacement of fuse element modules in electrical equipment while the equipment remains in service and with minimal disruption to a power distribution system.

III. CONCLUSION

The benefits and advantages of the invention are now believed to be amply demonstrated in the various embodiments disclosed.

An embodiment of a separable insulated connector is disclosed. The connector, comprises: an insulating housing; a conductive ground plane extending on an outer surface of the housing; a shield housing situated within the housing and having an axial passage therethrough, the passage having an open end; a contact element mounted within the axial passage and spaced an axial distance from the open end; and wherein the connector is configured for making and breaking high voltage connections that are energized but not carrying load current.

Optionally, the shield housing may extend less than the entire axial distance between the contact and the open end. The connector may further comprise insulation extending on an interior surface of the shield housing between the contact and the open end. The contact element may comprise contact fingers facing the open end, and the contact element may be fixedly mounted in the shield housing in all operating conditions. Insulation may be provided that increases a track length between the contact element and the ground plane. The insulation may extend substantially the entire axial distance from the open end to the contact. The connector may be adapted to make or break an energized electrical connection without an arc arc-ablative component.

Another embodiment of a separable insulated connector for making or breaking an energized connection in a power distribution network is also disclosed. The connector comprises: a conductive shield housing having an end, and an axial passage therethrough; a contact element within the tube and recessed from the end; an insulation surrounding the shield housing; a ground plane provided on the insulation; and a continuous, uninterrupted insulation system extending from the contact element to the ground plane.

Optionally, the insulation system may comprise a nonconductive nosepiece. The insulation system may comprise an extension of the housing to a distal end of the connector, thereby increasing a creep distance along the insulation system. The nosepiece may project beyond the end of the shield housing, thereby increasing a track length along a path extending from the contact to the ground plane. The nosepiece may overlap an interior surface of the shield housing between the contact element and the end of the tube. The contact element may be fixedly mounted in the shield housing in all operating conditions. The connector may be configured to be separable at rated voltage of electrical equipment but in the absence of load current. The connector may have a current rating above 200 A. The connector may be configured to make or break high voltage connections exceeding 10 kV, and the connector may be adapted to make or break an electrical connection without an arc arc-ablative component.

An embodiment of a separable insulated connector to make or break a medium voltage connection with a male contact of a mating connector in a power distribution network is also disclosed. The separable connector comprises: a conductive shield housing having an axial passage therethrough; a contact within the tube; an insulation surrounding the shield housing; a ground plane provided on an outer surface of the insulation; and an insulation system configured to prevent instances of flashover when energized connections at rated voltage, but in the absence of load current, are made and broken.

Optionally, the insulation system provides a continuous, uninterrupted insulation system extending from the contact element to the ground plane. The insulation system may comprise a nonconductive nosepiece, and the insulation system may comprise an extension of the housing to a distal end of the connector, thereby increasing a creep distance along the insulation system. The nosepiece may project beyond the end of the shield housing, thereby increasing a track length along a path extending from the contact to the ground plane, and the nosepiece may overlap an interior surface of the shield housing between the contact element and the end of the tube. The contact element may be fixedly mounted in the shield housing in all operating conditions The connector may be configured to make or break high voltage connections exceeding 10 kV, and the connector may have a current rating above 200 A. The connector may be adapted to make or break an electrical connection without an arc arc-ablative component.

An embodiment of a separable insulated connector for a medium voltage power distribution system is also disclosed. The connector comprises: passage means for defining an axial contact passage; contact means, fixedly located within the axial contact passage under all operating conditions, for making or breaking an energized electrical connection in a power distribution network; means for providing a ground plane; and means for providing a continuous, uninterrupted insulation system extending from the contact means to the ground plane, whereby energized connections to the electrical equipment may be made and broken at rated voltage but in the absence of load current, without instances of flashover between the contact means and the means for providing a ground plane.

Optionally, the means for providing a continuous, uninterrupted insulation system may comprise a nonconductive nosepiece. The insulation system may comprise an extension of the housing to a distal end of the connector, thereby increasing a creep distance along the insulation system. The insulation system may comprise a nosepiece projecting beyond the end of the shield housing, thereby increasing a track length along a path extending from the contact to the ground plane. The nosepiece may overlap an interior surface of the shield housing between the contact element and the end of the tube. The connector may have a current rating above 200 A. The connector may be configured as a bushing for electrical equipment.

A method of servicing solid dielectric insulated electrical equipment in a power distribution system is also disclosed. The electrical equipment includes at least one protection element connected thereto and adapted to open a current path in response to specified current conditions. The method comprises: connecting line-side and load-side cables to the electrical equipment; energizing the equipment; and removing and replacing the protection element while the protecting element is energized at rated voltage, but not carrying load current.

Optionally, the method further comprises providing a medium voltage separable energized break connector configured to make and break electrical connection to the protection element at the rated voltage, but in the absence of load current. The electrical equipment may comprise switchgear. The protective element may comprise a fuse. The connector may be configured to make or break high voltage connections exceeding 10 kV. The electrical equipment may be a dead-front apparatus, and the method may further comprise providing a ground plane on the separable energized break connector.

While the invention has been described in terms of various specific embodiments, those skilled in the art will recognize that the invention can be practiced with modification within the spirit and scope of the claims.

What is claimed is:

1. A separable insulated connector, comprising:

an insulation system defining an insulating housing;

a conductive ground plane extending on an outer surface of the insulating housing;

a shield housing situated within the insulating housing;

an axial passage that extends through at least a portion of the shield housing, the axial passage defining an open end of the connector;

a contact element mounted within the axial passage and spaced an axial distance from the open end, wherein the connector connects and disconnects with another connector to make and break high voltage connections that are energized but not carrying load current, wherein, when connecting and disconnecting the connectors, the insulation system mitigates substantially all risk of flashover at the open end only when the connector is not carrying load current, wherein the insulation system comprises continuous, uninterrupted insulation extending along an arc path between the contact element and the ground plane, the connector being devoid of any gaps in the insulation system along the arc path; and wherein the insulation system comprises a nonconductive nosepiece, and an extension of the housing to a distal end of the connector, thereby increasing a creep distance along the insulation system.

2. The connector of claim 1, wherein the shield housing extends less than the entire axial distance between the contact and the open end.

3. The connector of claim 1, further comprising insulation extending on an interior surface of the shield housing between the contact and the open end.

4. The connector of claim 1, wherein the contact element comprises contact fingers facing the open end.

5. The connector of claim 1, wherein the contact element is fixedly mounted in the shield housing in all operating conditions.

6. The connector of claim 1, further comprising insulation that increases a track length between the contact element and the ground plane.

7. The connector of claim 1, wherein the connector includes insulation extending substantially the entire axial distance from the open end to the contact.

8. The connector of claim 1, wherein the connector is configured to make or break high voltage connections exceeding 10 kV.

9. The connector of claim 1, wherein the connector is adapted to make or break an energized electrical connection without an arc arc-ablative component.

10. The connector of claim 1, wherein the connector does not include any arc ablative components.

11. A separable insulated connector for making or breaking an energized connection in a power distribution network, the connector comprising:

a conductive shield housing having an end and an axial passage therethrough;

a contact element disposed within the conductive shield housing, recessed from the end;

an insulation system defining an insulating housing that surrounds the shield housing; and a ground plane provided on the insulating housing;

wherein the insulation system comprises continuous, uninterrupted insulation extending along an arc path between the contact element and the ground plane, the connector being devoid of any gaps in the insulation system along the arc path;

wherein the insulation system comprises a nonconductive nosepiece and an extension of the housing to a distal end of the connector, thereby increasing a creep distance along the insulation system;

wherein the connector is separable from another connector to break voltage connections that are not carrying load current, but the connector is configured for safe disconnection from the other connector only when the voltage connections are not carrying load current.

12. The connector of claim 11, wherein the nosepiece projecting beyond the end of the shield housing, thereby increasing a track length along a path extending from the contact to the ground plane.

13. The connector of claim 11, wherein the nosepiece overlapping an interior surface of the shield housing between the contact element and the end of the shield housing.

14. The connector of claim 11, wherein the contact element is fixedly mounted in the shield housing in all operating conditions.

15. The connector of claim 11, wherein the connector has a current rating above 200 A.

16. The connector of claim 11, wherein the connector is configured to make or break high voltage connections exceeding 10 kV.

17. The connector of claim 11, wherein the connector is adapted to make or break an electrical connection without an arc arc-ablative component.

18. The connector of claim 11, wherein the connector does not include any arc ablative components.

19. A separable insulated connector to make or break a medium voltage connection with a male contact of a mating connector in a power distribution network, the separable connector comprising:

a conductive shield housing having an axial passage therethrough;

a contact disposed within the conductive shield;

an insulation system defining an insulating housing that surrounds the shield housing;

a ground plane provided on an outer surface of the insulating housing, wherein the insulation system is configured to prevent instances of flashover when energized connections at rated voltage, but in the absence of load current, are made and broken, the insulation system comprising continuous, uninterrupted insulation along an arc path between the contact element and the ground plane the connector being devoid of any gaps in the insulation system along the arc path, wherein the connector is configured for safely connecting and disconnecting with another connector to make and break high voltage connections only when the connector is not carrying load current; and wherein the insulation system comprises a nonconductive nosepiece and an extension of the housing to a distal end of the connector, thereby increasing a creep distance along the insulation system.

20. The connector of claim 11, wherein the nosepiece projecting beyond the end of the shield housing, thereby increasing a track length along a path extending from the contact to the ground plane.

21. The connector of claim 11, wherein the nosepiece overlapping an interior surface of the shield housing between the contact element and the end of the shield housing.

22. The connector of claim 19, wherein the contact element is fixedly mounted in the shield housing in all operating conditions.

23. The connector of claim 19, wherein the connector is configured to make or break high voltage connections exceeding 10 kV.

24. The connector of claim 19, wherein the connector has a current rating above 200 A.

25. The connector of claim 19, wherein the connector is adapted to make or break an electrical connection without an arc arc-ablative component.

26. The connector of claim 20, wherein the connector does not include any arc ablative components.

* * * * *

UNITED STATES PATENT AND TRADEMARK OFFICE

CERTIFICATE OF CORRECTION

PATENT NO. : 7,950,939 B2
APPLICATION NO. : 11/677703
DATED : May 31, 2011
INVENTOR(S) : David Charles Hughes et al.

It is certified that error appears in the above-identified patent and that said Letters Patent is hereby corrected as shown below:

Column 14, lines 57-58
Claim 26 should depend from claim 19 and read as follows:

26. The connector of claim 19, wherein the connector does not include any arc ablative components.

Signed and Sealed this
Sixteenth Day of August, 2011

David J. Kappos
*Director of the United States Patent and Trademark Office*